US009570260B2

(12) United States Patent
Yang et al.

(10) Patent No.: US 9,570,260 B2
(45) Date of Patent: Feb. 14, 2017

(54) THERMAL METAL OXIDE VARISTOR CIRCUIT PROTECTION DEVICE

(75) Inventors: Wen Yang, Guangdong (CN); Hailang Tang, Hunan (CN); Hongbing Liu, Chongqing (CN)

(73) Assignee: Littelfuse, Inc., Chicago, IL (US)

( * ) Notice: Subject to any disclaimer, the term of this patent is extended or adjusted under 35 U.S.C. 154(b) by 439 days.

(21) Appl. No.: 14/232,412

(22) PCT Filed: Jun. 17, 2011

(86) PCT No.: PCT/CN2011/075879

§ 371 (c)(1),
(2), (4) Date: Apr. 7, 2014

(87) PCT Pub. No.: WO2012/171221

PCT Pub. Date: Dec. 20, 2012

(65) Prior Publication Data

US 2014/0232512 A1 Aug. 21, 2014

(51) Int. Cl.
*H01H 61/02* (2006.01)
*H01H 37/76* (2006.01)
(Continued)

(52) U.S. Cl.
CPC ..... *H01H 61/02* (2013.01); *H01H 37/761* (2013.01); *H01C 7/10* (2013.01); *H01C 7/12* (2013.01); *H01H 9/32* (2013.01); *H01H 2037/762* (2013.01)

(58) Field of Classification Search
CPC H01H 61/02; H01H 37/761; H01H 2037/762; H01H 9/32; H01C 7/10; H01C 7/12
(Continued)

(56) References Cited

U.S. PATENT DOCUMENTS 6,040,971 A * 3/2000 Martenson ..... H01C 7/12 361/103
6,211,770 B1 * 4/2001 Coyle ..... H01C 7/126 338/101
(Continued)

FOREIGN PATENT DOCUMENTS

CN 1947317 A 4/2007
CN 101048923 A 10/2007
(Continued)

OTHER PUBLICATIONS

CN 101546910—(Sep. 3, 2009) English Translation.*
(Continued)

*Primary Examiner* — Anatoly Vortman

(57) ABSTRACT

A circuit protection device including a housing, a metal oxide varistor disposed within said housing, a terminal having a contact lead at a first end electrically attached to said metal oxide varistor by solder and having a second end extending outside of said housing, an arc shield disposed within said housing between said contact lead and said metal oxide varistor, a micro switch housed in a pocket portion of the housing, said micro switch having a trigger portion and an indicator portion disposed at least partially outside of said housing, said arc shield positioned against said trigger portion, and a spring configured to bias said arc shield away from said pocket portion and to move said arc shield away from said trigger portion when said solder is melted to provide a barrier between said metal oxide varistor and said contact lead, whereby the indicator portion is retracted into the housing.

6 Claims, 4 Drawing Sheets

(51) Int. Cl.
*H01C 7/10* (2006.01)
*H01C 7/12* (2006.01)
*H01H 9/32* (2006.01)

(58) Field of Classification Search
USPC ..... 337/401
See application file for complete search history.

(56) References Cited

U.S. PATENT DOCUMENTS

| | | | | |
|---|---|---|---|---|
| 6,430,019 | B1 * | 8/2002 | Martenson | H01C 7/126 361/103 |
| 7,477,503 | B2 * | 1/2009 | Aszmus | H01C 7/126 361/103 |
| 7,483,252 | B2 * | 1/2009 | de Palma | H01C 7/112 361/127 |
| 7,839,257 | B2 * | 11/2010 | Cernicka | H01C 7/126 337/142 |
| 7,932,807 | B2 | 4/2011 | Sato et al. | |
| RE42,319 | E | 5/2011 | Martenson et al. | |
| 8,031,456 | B2 * | 10/2011 | Wang | H01T 1/14 361/117 |
| 8,378,778 | B2 * | 2/2013 | Duval | H01C 7/126 338/13 |
| 8,836,464 | B2 * | 9/2014 | Wang | H01C 7/126 337/401 |
| 9,165,702 | B2 * | 10/2015 | Hagerty | H01C 7/126 |
| 2012/0068806 | A1 * | 3/2012 | Guarniere | H01C 7/10 337/1 |
| 2013/0114177 | A1 * | 5/2013 | Mosesian | H01C 7/126 361/88 |

FOREIGN PATENT DOCUMENTS

| | | | |
|---|---|---|---|
| CN | 101546910 | A | 9/2009 |
| JP | H04055730 | A | 5/1992 |
| JP | 09134809 | H | 5/1997 |
| JP | H10144506 | A | 5/1998 |
| JP | 2007288114 | A | 11/2007 |
| JP | 2007324535 | A | 12/2007 |
| JP | 2009218508 | A | 9/2009 |
| JP | 2009239231 | A | 10/2009 |
| JP | 2010211928 | A | 9/2010 |

OTHER PUBLICATIONS

Office Action from corresponding Japanese Patent Application No. 2014-515029 mailed Mar. 16, 2015.
International Search Report dated Mar. 29, 2012 issued in corresponding PCT/CN2011/075879 filed Jun. 17, 2011.

* cited by examiner

THERMAL METAL OXIDE VARISTOR CIRCUIT PROTECTION DEVICE

BACKGROUND OF THE INVENTION

Field of the Invention

Embodiments of the invention relate to the field of circuit protection devices. More particularly, the present invention relates to a surge protection device with a thermal disconnect system configured to provide fast response to overheating.

Discussion of Related Art

Over-voltage protection devices are used to protect electronic circuits and components from damage due to over-voltage fault conditions. These over-voltage protection devices may include metal oxide varistors (MOVs) that are connected between the circuits to be protected and a ground line. MOVs have a unique current-voltage characteristic that allows them to be used to protect such circuits against catastrophic voltage surges. Typically, these devices utilize thermal links which can melt during an abnormal condition to form an open circuit. In particular, when a voltage that is larger than the nominal or threshold voltage is applied to the device, current flows through an MOV which generates heat. This causes the thermal link to melt. Once the link melts, an open circuit is created which prevents the over-voltage condition from damaging the circuit to be protected. However, these existing circuit protection devices do not provide an efficient heat transfer from the MOV to the thermal link, thereby delaying response times. In addition, existing circuit protection devices are complicated to assembly which increases manufacturing costs. Accordingly, it will be appreciated that improvements are desirable in present day circuit protection device employing metal oxide varistors.

SUMMARY OF THE INVENTION

Exemplary embodiments of the present invention are directed to a circuit protection device. In an exemplary embodiment, the circuit protection device includes a housing defining a cavity and a metal oxide varistor (MOV) disposed within the cavity. A first terminal is electrically attached at a first end to the MOV by solder and extends outside of the housing at a second end. An arc shield is disposed within the housing between the first end of the first terminal and at least partially over the solder. A spring is also included that is configured to bias the arc shield against a micro switch having an indicator portion disposed at least partially outside of the housing. When a voltage surge condition occurs, the MOV changes from a non-conductive state to a conductive state and current flows between the first terminal and a second terminal. The heat generated by the current flowing through the varistor melts the solder and the first end of the first terminal separates from the varistor thereby creating an open circuit.

In another exemplary embodiment, a circuit protection device includes a housing defining a cavity and a metal oxide varistor disposed within the cavity and including a protrusion extending from a surface of the metal oxide varistor. A terminal is electrically attached at a first end to the protrusion by solder and a second end extends outside of the housing where the terminal forms a spring biased away from the protrusion. The circuit protection device may also comprise a micro switch having an indicator portion disposed at least partially outside of the housing. A portion of the terminal forces a trigger portion of the micro switch in a first position corresponding to a normal operating condition of the circuit protection device.

DESCRIPTION OF EMBODIMENTS

Figure 1:
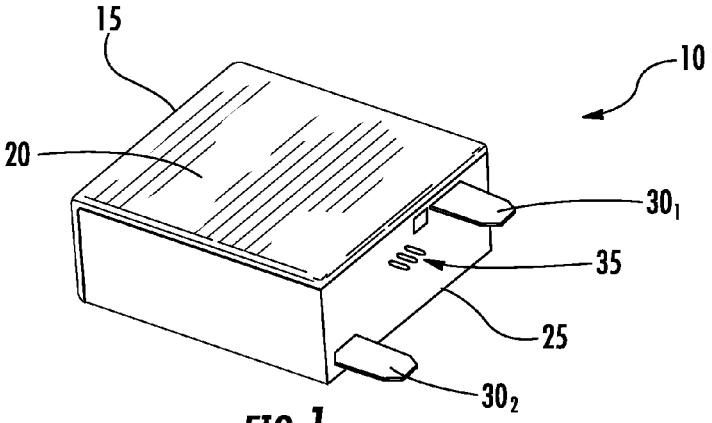
FIG. 1 is a perspective view of a circuit protection device in accordance with an embodiment of the present disclosure.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

In the following description and/or claims, the terms "on," "overlying," "disposed on" and "over" may be used in the following description and claims. "On," "overlying," "disposed on" and "over" may be used to indicate that two or more elements are in direct physical contact with each other. However, "on,", "overlying," "disposed on," and over, may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

FIG. 1 is a perspective view of a circuit protection device 10 including a housing 15 and a first terminal $\mathbf{30}_1$ and a second terminal $\mathbf{30}_2$. First terminal $\mathbf{30}_1$ and second terminal $\mathbf{30}_2$ are used to connect the protection device 10 between a source of power and a device to be protected in accordance with an embodiment of the present disclosure. Housing 15 may be defined by a cover portion 20 disposed on or over a base portion 25. The housing 15 defines a cavity therein to accommodate a metal oxide varistor (MOV) shown in FIG. 2. Housing 15 also includes one or more apertures to accommodate a visible portion of a micro switch used to indicate the condition of the circuit protection device.

Figure 2:
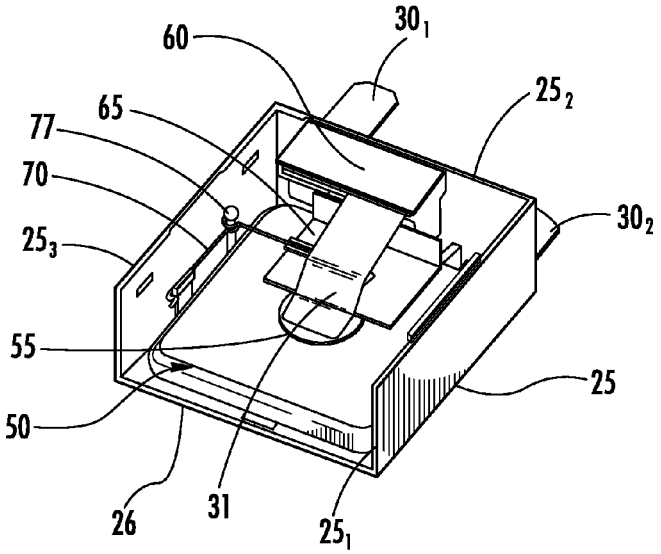
FIG. 2 is a cut-away perspective view of a circuit protection device shown in a normal operating condition in accordance with an embodiment of the present disclosure.
Figure 3:
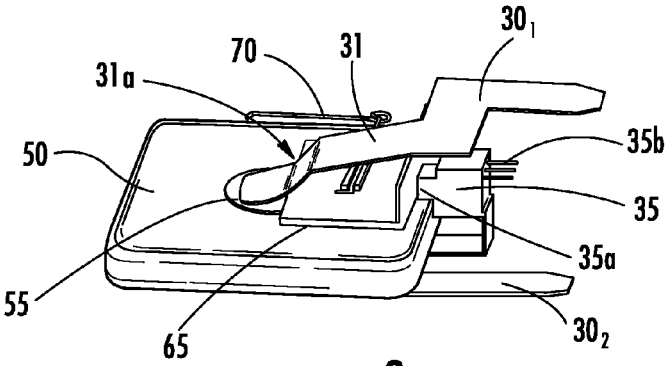
FIG. 3 is a perspective view of the metal oxide varistor portion outside of the housing shown in FIGS. 1 and 2 in accordance with an embodiment of the present disclosure.

FIG. 2 is a cut-away perspective view of the circuit protection device shown in FIG. 1 in a normal operating condition. Base 25 of housing 15 includes a bottom wall 26 and side walls $\mathbf{25}_1$, $\mathbf{25}_2$, and $\mathbf{25}_3$ to define the cavity within which the MOV 50 is disposed. As illustrated, MOV 50 is generally rectangular in shape and therefore the cavity defined by the bottom and side walls of base 25 is also generally rectangular in shape. As will be appreciated, alternative shapes of MOV 50 may also be employed and base portion 25 as well as housing 15 will likewise have an alternative shape to accommodate the MOVs. In addition, the MOV 50 may also be a pair of MOVS in parallel. Side wall $\mathbf{25}_2$ includes a pocket portion 60 which at least partially houses micro switch 35 (shown in FIG. 3) and a portion of contact lead 31 of terminal $\mathbf{30}_1$. A first end of lead portion 31 extends over arc shield 65 and is attached to one side of MOV 50 via solder 55. A first end of terminal $\mathbf{30}_2$ is attached to the opposite side of MOV 50 (as shown in FIG. 3). The solder is typically a low temperature softening or melting solder such as, for example, a metal alloy or a polymer. This connection between the contact lead 31 and MOV 50 via solder 55 provides the thermal fuse configuration (i.e. TMOV) of the circuit protection device 10 as described in more detail below.

The arc shield 65 is retained in position by a combination of spring 70 and the connection formed between contact lead 31 and solder 55. In particular, spring 70 is shown as an "L" shaped spring with a first portion connected to wall $\mathbf{25}_3$ and a second portion connected to arc shield 65 with a pivot pin 75 centrally disposed between the first and second portions of the spring. Pivot pin 75 extends generally perpendicularly from bottom wall 26 of base 25. Spring 70 biases arc shield 65 away from pocket portion 60, but is retained in position by contact lead 31 when contact lead is connected to solder 55.

As noted above, terminal $\mathbf{30}_1$ is attached to one side of MOV 50 via solder 55 and terminal $\mathbf{30}_2$ is attached to the opposite side of MOV 50 via a similar solder pad. The MOV is a voltage sensitive device which heats-up when the voltage applied across the device exceeds its rated voltage. By the way of background, MOVs are primarily comprised of zinc oxide granules that are sintered together to form a disc where the zinc oxide granule, as a solid, is a highly conductive material, while the intergranular boundary formed of other oxides is highly resistive. Only at those points where zinc oxide granules meet does sintering produce a 'microvaristor' which is comparable to symmetrical zener diodes. The electrical behavior of a metal oxide varistor results from the number of microvaristors connected in series or in parallel. The sintered body of an MOV also explains its high electrical load capacity which permits high absorption of energy and thus, exceptionally high surge current handling capability.

FIG. 3 is a side perspective view of the metal oxide varistor portion outside of housing 15 without pocket portion 60 shown in FIGS. 1 and 2 to better illustrate the configuration of arc shield 65 and micro switch 35. In particular, a rear wall of arc shield 65 abuts an activating trigger portion 35*a* of micro switch 35. An indicator portion 35*b* protrudes from micro switch 35 and aligns with the apertures of base 25 as shown in FIG. 1. In this exemplary embodiment, indicator portion 35*b* includes a plurality of pins that extend from a base of micro switch 35 and trigger portion 35*a* is normally in a depressed state. As will be appreciated, alternative configurations of micro switch 35 including trigger portion 35*a* and indicator portion 35*b* may also be employed. For example, trigger indicator portion 35*a* may normally be extended and indicator portion 35*b* may normally be un-extended.

As can be seen from this side perspective view, contact lead 31 retains arc shield 65 in position against trigger portion 35*a* via connection with solder 55 while spring 70 biases arc shield 65 against portion 31*a* of contact lead 31. In normal operating conditions, the MOV 50 remains non-conductive when the voltage across the MOV remains below $V_N$. During these conditions, solder 55 is electrically attached to portion 31*a* of contact lead 31 to retain arc shield 65 in position against trigger portion 35*a* of micro switch 35 and the pins of indicator portion 35*b* are extended.

Figure 4:
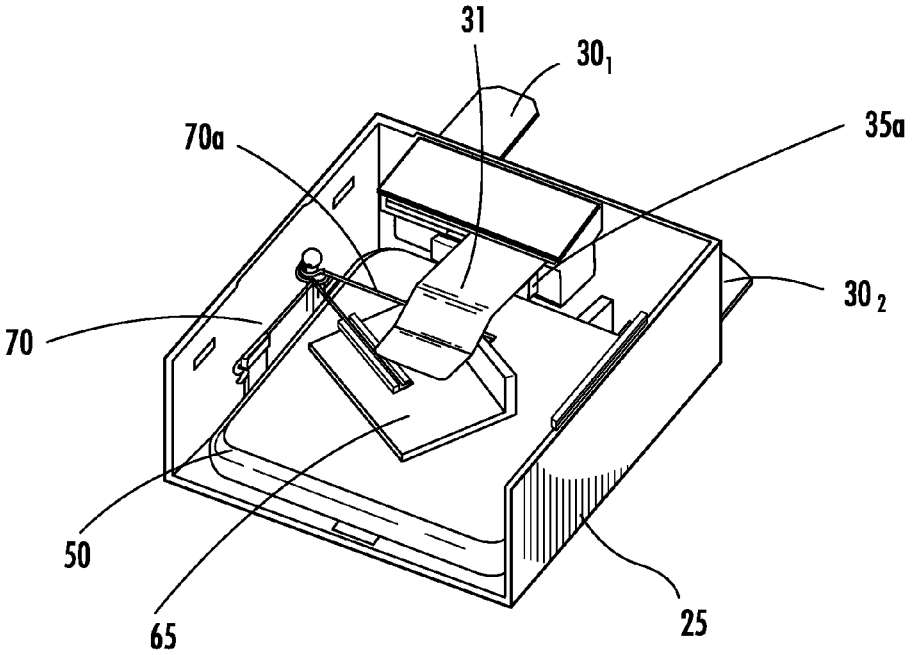
FIG. 4 is a perspective view of a circuit protection device without cover 20 showing the device after actuation of a fault condition in accordance with an embodiment of the present disclosure.

FIG. 4 is a perspective view of circuit protection device 10 without cover 20 (for illustrative purposes) showing the device after actuation of a fault condition. When a voltage surge condition occurs, the MOV 50 changes from a non-conductive state to the conductive state and current flows between terminals $\mathbf{30}_1$ and $\mathbf{30}_2$. As the voltage surge continues, the gaps and boundaries between the zinc oxide granules within MOV 50 is not wide enough to block current flow, and thus the MOV 50 becomes highly conductive. This conduction generates heat which melts solder 55 and releases contact lead 31 from electrical contact with solder 55. When multiple MOVs are configured in parallel, an electrically conductive terminal may be disposed between the parallel MOVs 50 to provide efficient heat transfer therebetween. The contact lead 31 acts as a thermal fuse which opens upon the generation of enough heat from MOV 50 to melt solder 55. Consequently, arm 70*a* of spring 70, which is attached to arc shield 65, forces the arc shield away from trigger portion 35*a* of micro switch 35. The circuit protection device 10 provides a relatively fast response to current flow through MOV 50 caused by the fault condition.

Figure 5:
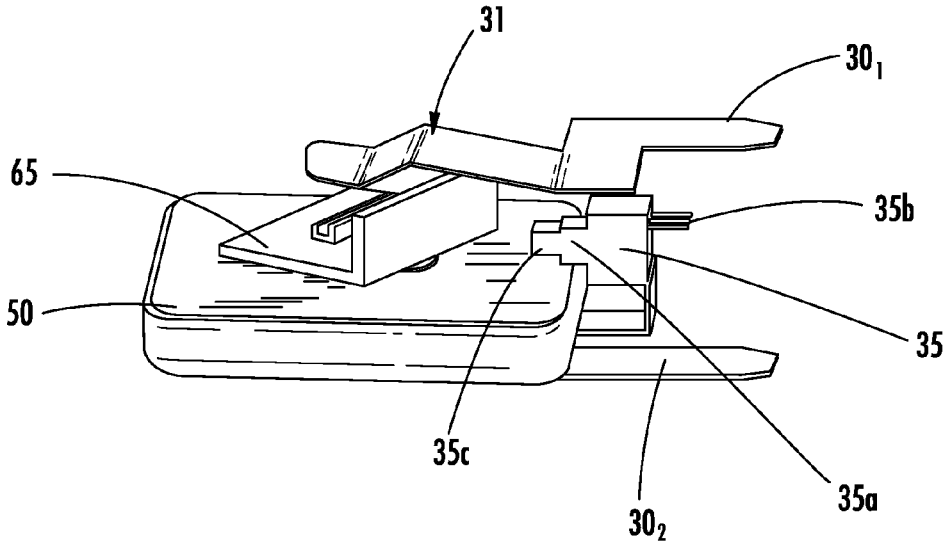
FIG. 5 is a perspective view of the metal oxide varistor portion outside of the housing shown in FIG. 4 after actuation of a fault condition in accordance with an embodiment of the present disclosure.

FIG. 5 is a side perspective view of the metal oxide varistor portion 50 outside of housing 15 without pocket portion shown in FIG. 4 to better illustrate the operation of arc shield 65 in combination with micro switch 35. Once arc shield 65 is released by the melting of solder 55, trigger extension 35*c* is released from trigger portion 35*a* of micro switch 35. In this configuration, the micro switch is isolated from the circuit formed between the terminals $\mathbf{30}_1$, $\mathbf{30}_2$ and MOV 50 allowing for improved circuit monitoring. In addition, the arc shield 65 prevents arcing from MOV 50 from reaching contact lead 31. Thus, the electrical path between terminals $\mathbf{30}_1$ and $\mathbf{30}_2$ via MOV 50 opens upon the occurrence of a sustained surge voltage depending on the rating of circuit protection device 10.

Figure 6:
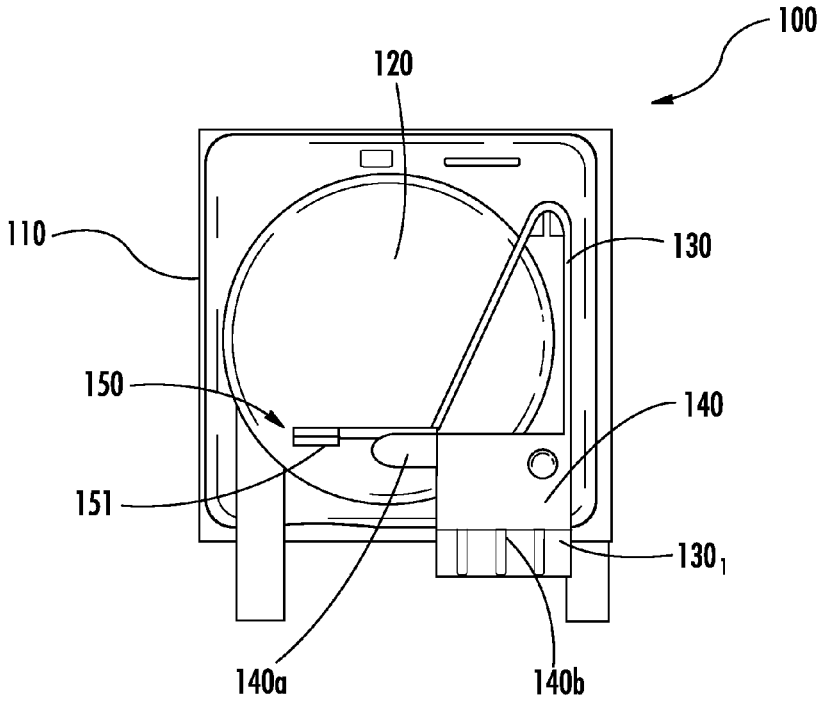
FIG. 6 is cut-away plan view of an alternative embodiment of a circuit protection device in a normal non-conducting condition in accordance with an embodiment of the present disclosure.

FIG. 6 is a cut-away plan view of an alternative embodiment of circuit protection device 100 in a normal non-conducting or off condition. A housing 110 defines a cavity within which MOV 120 is disposed. Although MOV 120 is illustrated as having a generally circular configuration, alternative shapes such as, for example, square may also be employed. A first terminal $\mathbf{130}_1$ and second terminal $\mathbf{130}_2$ extend from a bottom of housing 110. First terminal $\mathbf{130}_1$ extends into housing 120 and forms spring terminal 130. MOV 120 includes a protrusion 151 that acts as an electrical terminal connection from MOV 120 to spring terminal 130 via solder joint 150. The solder is typically a low temperature softening or melting solder such as, for example, a metal alloy or a polymer. This connection between spring terminal 130 and MOV 120 via solder joint 150 provides the thermal fuse configuration of the circuit protection device 100. Spring terminal 130 is shown as having a generally upside down "V" configuration. This configuration provides a bias force to spring terminal 130 upwards or away from protrusion 151. A micro switch 140 is disposed generally within housing 110 with a trigger portion 140*a* and indicator portion 140*b* having indicator pins.

Figure 7:
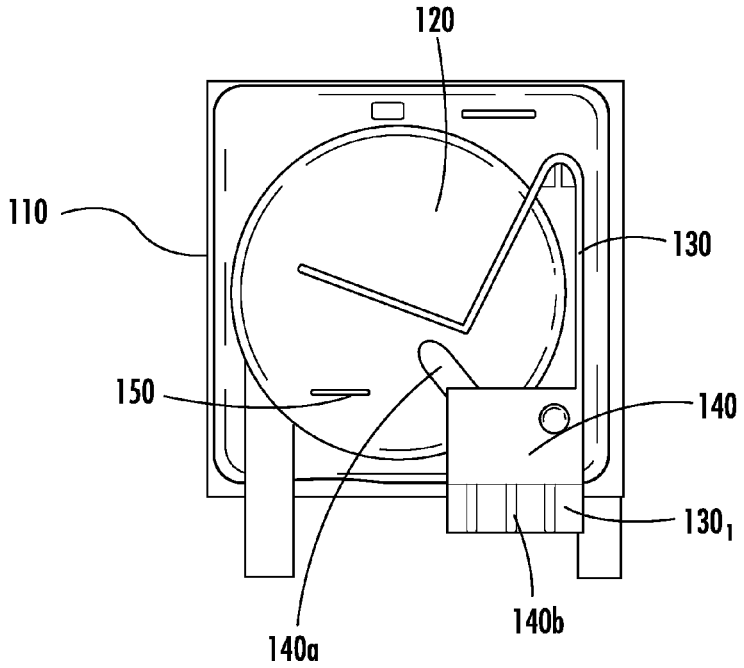
FIG. 7 is a cut-away plan view of the circuit protection device of FIG. 6 showing the device after actuation of a fault condition in accordance with an embodiment of the present disclosure.

FIG. 7 is a cut-away plan view of circuit protection device 100 showing the device after actuation of a fault condition. When a voltage surge condition occurs, the MOV 120 changes from a non-conductive state to the conductive state and current flows between terminals $\mathbf{130}_1$ and $\mathbf{130}_2$. As the voltage surge continues, the gaps and boundaries between the zinc oxide granules within MOV 120 are not wide enough to block current flow, and thus the MOV becomes highly conductive. This conduction generates heat which melts solder 150 and releases spring terminal 130 from electrical contact with protrusion 151. When spring terminal 130 is released, trigger portion 140*a* of micro switch 140 moves upward to "trigger" the pins of indicating portion 140*b*. In this configuration, the micro switch 140 is isolated from the circuit formed between the terminals $\mathbf{130}_1$, $\mathbf{130}_2$ and MOV 120 allowing for improved circuit monitoring. Since the pins extend outside of housing 110, they provide an indication that the circuit protection device 100 has been opened. In addition, MOV 120 may also be configured as a plurality of MOVs in parallel used in circuit protection device 100.

Figure 8:
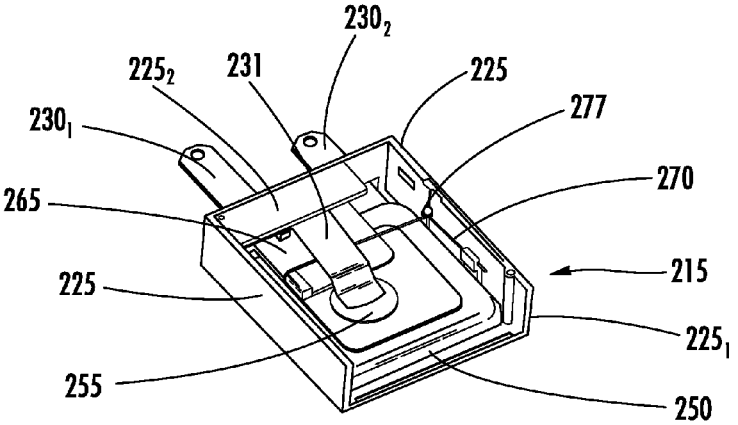
FIG. 8 is a cut-away perspective view of a circuit protection device shown in a normal operating condition in accordance with an embodiment of the present disclosure.
Figure 9:
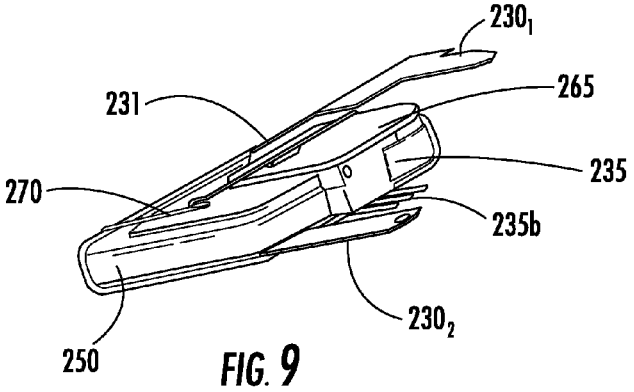
FIG. 9 is a perspective view of the metal oxide varistor portion outside of the housing shown in FIG. 8 in a normal operating condition in accordance with an embodiment of the present disclosure.

FIG. 8 is a cut-away perspective view of another exemplary embodiment of a circuit protection device 200 shown in a normal operating condition. Base 225 of housing 215 includes a cavity within which an MOV 250 is disposed with a first terminal $\mathbf{230}_1$ and a second terminal $\mathbf{230}_2$. First terminal 2301 extends through an opening in base 225 to form a first lead portion 231 which extends over arc shield 265 and is attached to one side of MOV 250 via solder 255. A first end of terminal $\mathbf{230}_2$ is attached to the opposite side of MOV 50 (as shown in FIG. 9). The solder 255 is typically a low temperature softening or melting solder. This connection between the contact lead 231 and MOV 50 via solder 255 provides the thermal fuse configuration (i.e. TMOV) of the circuit protection device 200.

The arc shield 265 is retained in position by a combination of spring 270 and the connection formed between contact lead 231 and solder 255. In particular, spring 270 is shown as an "L" shaped spring with a first portion connected to a wall $\mathbf{225}_1$ and a second portion connected to arc shield 265 with a pivot pin 277 generally centrally disposed between the first and second portions of the spring. Although spring 270 is shown as having an "L" shape alternative configurations to retain arc shield 265 in position while biasing it toward contact lead 231 may be employed. Spring 270 biases arc shield 265 away from wall $\mathbf{225}_2$ of base 225, but is retained in position by contact lead 231 when contact lead is connected to solder 55. As noted above, terminal $\mathbf{230}_1$ is attached to one side of MOV 250 via solder 255 and terminal $\mathbf{230}_2$ is attached to the opposite side of MOV 50 via a similar solder pad. The MOV is a voltage sensitive device which heats-up when the voltage applied across the device exceeds its rated voltage.

FIG. 9 is a side perspective view of the metal oxide varistor 250 portion outside of base 225 to better illustrate the configuration of arc shield 265 and a micro switch 235 disposed at least partially under the arc shield in normal operation. In particular, a lower side of arc shield 265 retains an activating trigger portion 235*a* (shown in FIG. 11) of micro switch 235 in a retracted position. An indicator portion 235*b* of micro switch 235 aligns with apertures in a wall of base 225 to provide visible indication of the status of the protection device 200. In this exemplary embodiment, indicator portion 235*b* includes a plurality of pins that extend from a base of micro switch 235 and trigger portion 235*a* is normally in a depressed state by the position of arc shield 265. As will be appreciated, alternative configurations of micro switch 235 including trigger portion 235*a* and indicator portion 235*b* may also be employed.

As can be seen from this side perspective view, contact lead 231 retains arc shield 265 in position against trigger portion 235*a* of micro switch 245 via connection with solder 255 while spring 270 biases arc shield 265 against a portion of contact lead 31. In normal operating conditions, the MOV 250 remains non-conductive when the voltage across the MOV remains below $V_N$. During these conditions, solder 255 is electrically attached to the portion of contact lead 31 to retain arc shield 265 in position against trigger portion 235*a* of micro switch 35 and the pins of indicator portion 235*b* are extended.

Figure 10:
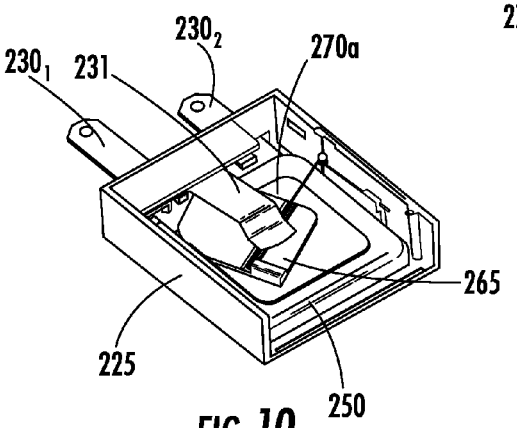
FIG. 10 is a perspective view of a circuit protection device without a cover showing the device after actuation of a fault condition in accordance with an embodiment of the present disclosure.

FIG. 10 is a perspective view of circuit protection device 200 without a cover (for illustrative purposes) showing the device after actuation of a fault condition. When a voltage surge condition occurs, the MOV 250 changes from a non-conductive state to the conductive state and current flows between terminals $\mathbf{230}_1$ and $\mathbf{230}_2$. As the voltage surge continues, the gaps and boundaries between the zinc oxide granules within MOV 250 are not wide enough to block current flow, and thus the MOV 250 becomes highly conductive. This conduction generates heat which melts solder 255 and releases contact lead 231 from electrical contact with solder 255. Alternatively, when multiple MOVs are configured in parallel instead of a single MOV, an electrically conductive terminal may be disposed between the parallel MOVs 250 to provide efficient heat transfer therebetween. The contact lead 231 acts as a thermal fuse which opens upon the generation of enough heat from MOV 250 to melt solder 255. Consequently, arm 270*a* of spring 270, which is attached to arc shield 265, forces the arc shield away from trigger portion 235*a* (shown in FIG. 11) of micro switch 235. The circuit protection device 200 provides a relatively fast response to current flow through MOV 50 caused by the fault condition.

Figure 11:
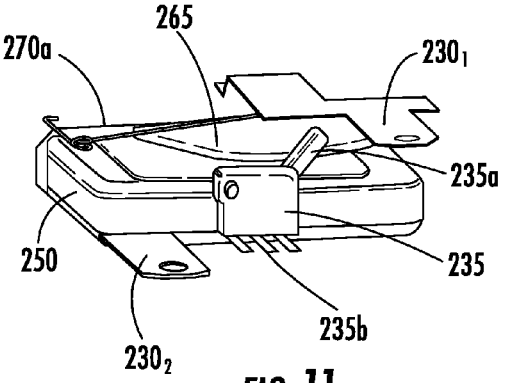
FIG. 11 is a perspective view of the metal oxide varistor portion outside of the housing showing the device after actuation of a fault condition in accordance with an embodiment of the present disclosure.

FIG. 11 is a side perspective view of the metal oxide varistor portion 250 outside of base 225 shown in FIG. 10 to better illustrate the operation of arc shield 265 in combination with micro switch 235 after the occurrence of a fault condition. Once arc shield 265 is released by the melting of solder 255 and the release of contact lead 231 therefrom, trigger portion 235*a* is released from micro switch 235 since the arc shield 265 is displaced away from the trigger portion 235*a* by arm 270*a* of bias spring 270. Upon the triggering of micro switch 235, the pins of indicator portion 235*b* may either extend further outside of base 225 or retract toward base 225 to provide a visual indication of the fault condition without the need to open the housing of the device. In this configuration, the micro switch 235 is isolated from the circuit formed between the terminals $\mathbf{230}_1$, $\mathbf{230}_2$ and MOV 250 allowing for improved circuit monitoring. In addition, the arc shield 265 prevents arcing from MOV 250 from reaching contact lead 231 since arc shield is displaced between contact lead 231 and solder 255 by spring 270 after the occurrence of the fault condition. Thus, the electrical path between terminals $\mathbf{230}_1$ and $\mathbf{230}_2$ via MOV 250 opens upon the occurrence of a sustained surge voltage depending on the rating of circuit protection device 200.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A circuit protection device comprising:

a housing defining a cavity;

a metal oxide varistor disposed within said cavity;

a terminal having a contact lead at a first end that is electrically attached to said metal oxide varistor by solder and having a second end extending outside of said housing;

an arc shield disposed within said housing between said contact lead and said metal oxide varistor;

a micro switch housed in a pocket portion of the housing, said micro switch having a trigger portion and further having an indicator portion disposed at least partially outside of said housing, said arc shield positioned against said trigger portion; and a spring configured to bias said arc shield away from said pocket portion and to move said arc shield away from said trigger portion when said solder is melted to provide a barrier between said metal oxide varistor and said contact lead, whereby the indicator portion is retracted into the housing.

2. The circuit protection device of claim 1 wherein said indicator portion of said micro switch includes at least one pin partially extending outside of said housing.

3. The circuit protection device of claim 1 wherein said spring comprises a first arm, a second arm and a pivot portion generally centrally disposed between the first and second arms of the spring.

4. The circuit protection device of claim 3 wherein the first arm of the spring is connected to said arc shield and the second arm of the spring is connected to an interior surface of a wall of the housing.

5. The circuit protection device of claim 1 wherein the terminal is a first terminal connected to a first side of the metal oxide varistor, the circuit protection device further comprising a second terminal having a first end electrically connected to a side opposite said first side of said metal oxide varistor.

6. The circuit protection device of claim 5 wherein a second end of said second terminal extends outside of said housing.

* * * * *